United States Patent [19]

Houghton et al.

[11] Patent Number: 4,966,131

[45] Date of Patent: Oct. 30, 1990

[54] ULTRASOUND POWER GENERATING SYSTEM WITH SAMPLED-DATA FREQUENCY CONTROL

[75] Inventors: Richard B. Houghton, Irvine; Dean C. Obray, Manhattan Beach, both of Calif.

[73] Assignee: Mettler Electronics Corp., Anaheim, Calif.

[21] Appl. No.: 154,180

[22] Filed: Feb. 9, 1988

[51] Int. Cl.[5] ..... A61H 1/00

[52] U.S. Cl. ..... 128/24 A; 310/316

[58] Field of Search ..... 310/316–319; 128/24 A, 660.01; 604/22

[56] References Cited

U.S. PATENT DOCUMENTS

| | | | |
|---|---|---|---|
| 2,444,349 | 10/1945 | Harrison . | |
| 2,752,512 | 5/1952 | Sarratt . | |
| 2,872,578 | 10/1954 | Kaplan . | |
| 3,254,284 | 5/1963 | Tomes . | |
| 3,256,498 | 11/1963 | Hurtig . | |
| 3,518,573 | 9/1968 | Smith . | |
| 3,651,352 | 12/1972 | Puskas . | |
| 3,713,045 | 6/1973 | Usuda . | |
| 3,742,492 | 11/1973 | Proctor . | |
| 3,924,335 | 12/1975 | Balamuth et al. . | |
| 3,964,487 | 12/1976 | Judson . | |
| 4,156,157 | 5/1978 | Mabille . | |
| 4,223,676 | 12/1977 | Wuchinich et al. . | |
| 4,275,363 | 6/1980 | Mishiro et al. . | |
| 4,368,410 | 10/1980 | Hance et al. | 128/24 A |
| 4,551,690 | 11/1985 | Quist | 310/316 |
| 4,583,529 | 4/1986 | Briggs | 128/24 A |
| 4,626,728 | 12/1986 | Flachenecker et al. | 310/316 |
| 4,658,172 | 4/1987 | Izukawa | 310/316 |
| 4,689,515 | 8/1987 | Benndorf et al. | 310/316 |
| 4,708,127 | 10/1987 | Abdelghani | 128/24 A |
| 4,754,186 | 6/1988 | Choperena et al. | 310/316 |
| 4,791,915 | 12/1988 | Barsotti et al. | 128/24 A |
| 4,823,775 | 4/1989 | Rindt | 128/24 A |

FOREIGN PATENT DOCUMENTS 5879399 8/1983 Japan .

OTHER PUBLICATIONS

*Solid State Power Circuits*, RCA Designer's Handbook, pp. 300–305 (Copyright 1971).

*Primary Examiner*—Ruth S. Smith

*Attorney, Agent, or Firm*—Christie, Parker & Hale

[57] ABSTRACT

A system is provided for applying ultrasound power to treat human tissue comprising a transducer driven by an oscillating signal from a power amplifier. The transducer and power amplifier have a power-conversion-efficiency characteristic which is a function of the frequency of the oscillating signal and the acoustic load on the transducer. Data sampling and frequency adjustment means are provided which continually monitor the current supplied to the crystal and adjust the frequency of the oscillating signal to maximize the power-conversion-efficiency of the transducer and power amplifier.

18 Claims, 9 Drawing Sheets

Fig. 2
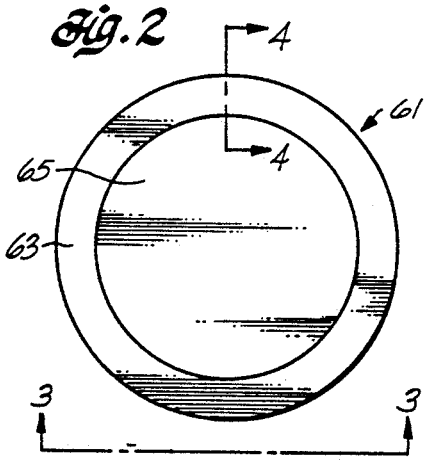
Fig. 4
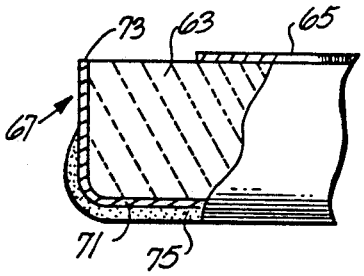
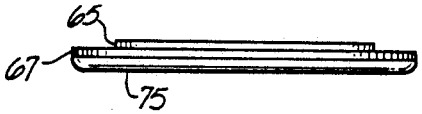
Fig. 3
Fig. 5
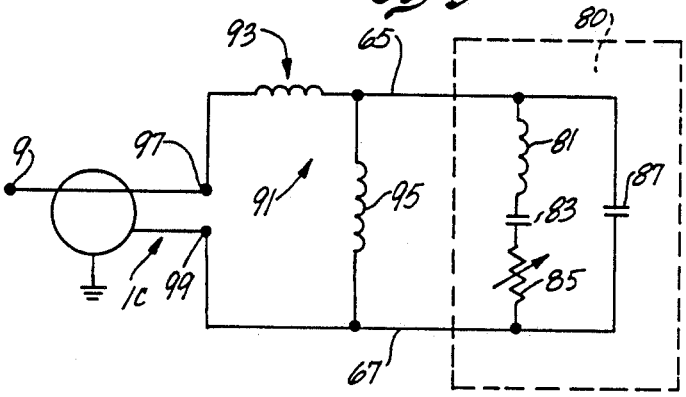

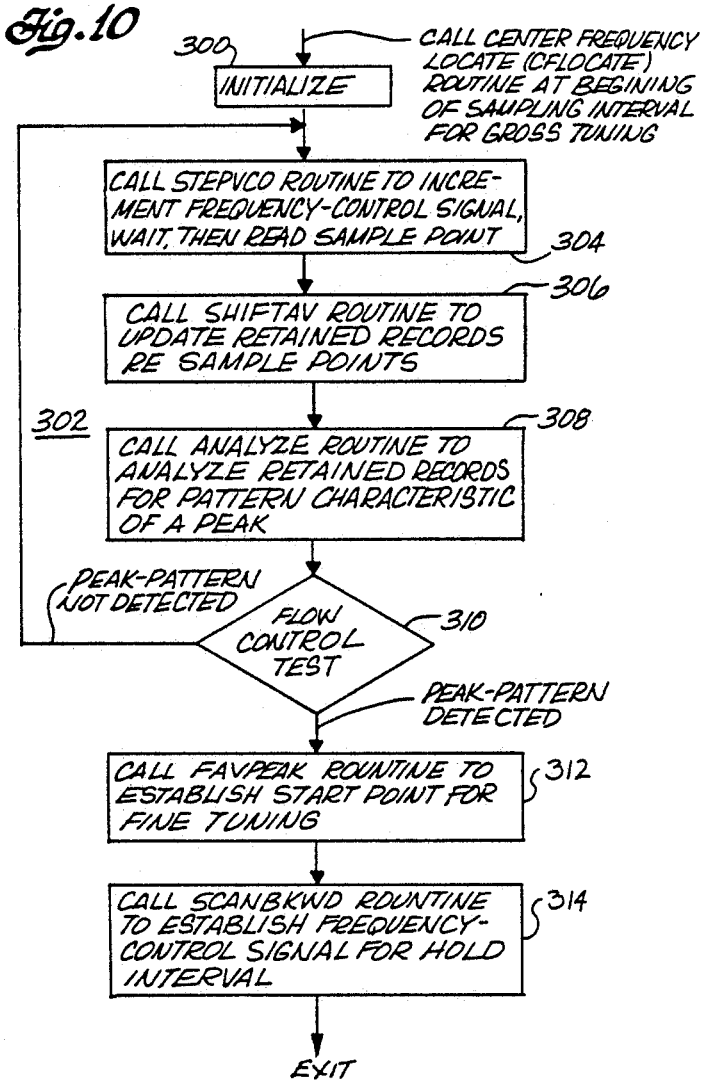
Fig. 10
300
INITIALIZE
CALL CENTER FREQUENCY LOCATE (CFLOCATE) ROUTINE AT BEGINING OF SAMPLING INTERVAL FOR GROSS TUNING
CALL STEPVCO ROUTINE TO INCREMENT FREQUENCY-CONTROL SIGNAL, WAIT, THEN READ SAMPLE POINT
304
306
CALL SHIFTAV ROUTINE TO UPDATE RETAINED RECORDS RE SAMPLE POINTS
302
308
CALL ANALYZE ROUTINE TO ANALYZE RETAINED RECORDS FOR PATTERN CHARACTERISTIC OF A PEAK
PEAK-PATTERN NOT DETECTED
FLOW CONTROL TEST
310
PEAK-PATTERN DETECTED
CALL FAVPEAK ROUNTINE TO ESTABLISH START POINT FOR FINE TUNING
312
CALL SCANBKWD ROUNTINE TO ESTABLISH FREQUENCY-CONTROL SIGNAL FOR HOLD INTERVAL
314
EXIT CALL ANALYZE ROUTINE
HAS COUNT (FSWPCNT) REACHED THRESHOLD COUNT ?
320
NO
YES
330
SUBTRACT NEWEST AVERAGE FROM OLDEST RETAINED AVERAGE SO AS TO SET CARRY IF NEGATIVE
HAVE ENOUGH RECORDS BEEN RETAINED TO FILL TABLE ?
322
YES
NO
DO RETAINED RECORDS INDICATE SUFFICIENTLY STEEP UPSLOPE ?
326
NO
YES
INCREMENT (FSWPCNT)
328
SET CARRY
324
EXIT TO FLOW CONTROL TEST

ULTRASOUND POWER GENERATING SYSTEM WITH SAMPLED-DATA FREQUENCY CONTROL

BACKGROUND OF THE INVENTION

This invention relates to a system and method in which sampled-data frequency control is used to tune an energizing signal for a crystal transducer, more particularly, a crystal transducer of the type used for generating ultrasound power to treat human tissue.

For many years, ultrasound power generating systems have been widely used for physical therapy, for example, for treating athletes for sore muscles and other ailments. The ultrasound power is generated by a transducer comprising a piezoelectric crystal and excitation electrodes bonded to the crystal. The transducer is mounted at a front end of a hand-held applicator and the excitation electrodes are electrically connected via wiring that extends through the hand-held applicator to a control unit in which an energizing power supply and various control circuits are housed. Such a piezoelectric crystal is disk shaped and thus has front and rear flat circular surfaces and a cylindrical edge surface. In an appropriate support and with appropriate alternating voltage applied across its excitation electrodes, the crystal conducts and vibrates at very high rates. It is practical and desirable for this rate to have a selectable, predetermined value in the of about one megahertz (1 Mhz) to about three megahertz (3 Mhz).

The natural mode of vibration of the crystal involves a relatively complex pattern that is generally symmetrical with respect to the axis of the disk. The pattern is affected by both fixed and variable elements of an acoustic load on the crystal. The fixed or relatively constant elements of the acoustic load on the crystal depend upon the way in which the crystal is arranged with respect to supporting and abutting structures.

Such structures include the means used to effect electrical contact between the excitation electrodes and wires that carry excitation current supplied to the crystal to flow through it and return to the energizing power supply. In one known arrangement of the excitation electrodes, a front excitation electrode is defined by a cup-shaped electrical coating, a circular portion of which covers all of the front face of the crystal and a cylindrical portion of which covers the peripheral edge of the crystal. A rear excitation electrode is a circular-shaped electrical coating covering substantially all of the rear circular face of the crystal. Another arrangement is the same except that the front excitation electrode is defined by just the cylindrical electrical coating. Either of these electrode arrangements is advantageous in terms of providing for cooperation with abutting structures without unduly disturbing the pattern of crystal vibration.

As for the front excitation electrode, an electrically conductive housing structure abutting its cylindrical portion provides reliable and effective means for making an electrical connection to a wire, with little if any disturbance of the vibration pattern of the crystal. As for the rear excitation electrode, any of various known resilient structures can abut it for making electrical connection. One known structure includes an electrically conductive body having a head with a flat circular surface for facing the excitation electrode, and a pin integral with the head, and a coil spring around the pin. An improved structure includes an electrically conductive wavy washer which makes multiple-point contact in a ring-shaped region of the excitation electrode. This structure is fully described in a concurrently filed, commonly assigned patent application titled "A Therapeutic Applicator For Ultrasound"; the inventors being T. Buelna and R. Houghton. Wires that carry current for the crystal extend a considerable distance within the hand-held applicator and from the hand-held applicator to the control unit. Because high frequencies are involved, it is most desirable to use coax cable; otherwise, an undesirable amount of radiation can occur.

It is desirable for the frequency of the energizing signal to be the resonant frequency of the crystal. The frequency at which the crystal resonates is a function of the acoustic load it drives. Factors that affect the acoustic load include whether the crystal is separated from the patient's skin by air, and whether a material with good ultrasonic transmissiveness has been applied. Such materials include saline solutions and gels. As for expressing the magnitude of an acoustic load quantitatively, this can be done as percentage of air coupling.

Variations in acoustic load affect the input impedance of the crystal, as well as its resonant frequency. A representative example involves a crystal that has a resonant frequency slightly above 1 Mhz while the acoustic load is about two per cent (2%) air coupling and it has a slightly lower resonant frequency when the acoustic load is about thirty per cent (30%) air coupling. This crystal has an input impedance of about 22 ohms under the conditions of resonance with the 2% air coupling, and an input .of .impedance of about 28 ohms under the conditions of resonance with the 30% air coupling. In each case, the input impedance at resonance is essentially resistive; i.e., components of capacitive reactance and of inductive reactance are essentially equal, and, being opposite in phase, cancel each other.

The variations in input impedance of a crystal pose a challenge with respect to meeting an important goal of efficiently energizing the crystal so as to minimize undesirable power dissipation in the energizing circuitry and attendant heating of the energizing circuitry. In this regard, the heating that occurs under commonly occurring operating conditions is such that it is necessary to provide a safety turn-off to prevent damage from overheating. This is the case even though relatively massive heat-sinking plates support the components of the energizing circuitry. Further with respect to variations in crystal input impedance, it is not only the magnitude that varies, but also the phase. In the frequency range just below the resonant frequency, the input impedance has a capacitive reactance component. In the frequency range just above the resonant frequency, the input impedance has an inductive reactance component. In either case, the voltage across the excitation electrodes is out of phase with respect to the current flowing through the crystal. Such a phase shift adversely affects the efficiency of the energizing circuitry. This is true even where the energizing circuitry is arranged for switching operation rather than less power-efficient linear operation.

As to approaches that have been proposed in the past, reference is made to U.S. Pat. No. 4,368,410 to Hance et al., and to U.S. Pat. No. 4,708,127 to Abdelghani.

The patent to Hance et al. proposes a manually tuned system in which a Colpitts oscillator has a manually adjustable impedance, and in which light emitting diodes (LEDs) display indications to guide a person to adjust the manually adjustable impedance to make a frequency adjustment in the correct direction for causing the Colpitts oscillator to oscillate at the resonant frequency of the crystal under particular acoustic load conditions.

The patent to Abdelghani proposes a system that requires a three-electrode crystal and that involves additional complexities with respect to electrical connections. Two of the three electrodes of the disclosed crystal are excitation electrodes, and the third is a feedback electrode. More particularly, the front face of the crystal has a circular excitation electrode, the rear face of the crystal has a annularly-shaped excitation electrode surrounding an uncoated annularly-shaped isolation region that, in turn, surrounds a centrally positioned, circular feedback electrode. In regard to operation, the patent to Abdelghani states that the front excitation electrode is grounded (i.e., 0 volts); the rear excitation electrode has applied to it a high-voltage, high-frequency drive signal; a feedback signal is generated across the feedback electrode and the ground excitation electrode; and the feedback signal has a component having a frequency equal to the resonant frequency of the crystal. In a control unit of the system, there is a circuit arrangement involving high and low pass filters, an automatic gain control (AGC) circuit, and an oscillator that locks onto a resonant frequency component.

As to effecting electrical connections between the control unit and the crystal, the patent to Abdelghani indicates generally that some kind of cable is provided, and does not indicate what type of shielding, if any, is provided. Shielding could be provided by resorting to two coax cables, one with the center conductor carrying the high-voltage drive signal, the other with the center conductor carrying the feedback signal, and with each having the shield grounded. The patent to Abdelghani discloses an electrically conductive abutting structure for making an essentially single-point, resilient contact to the feedback electrode. Drawbacks associated with this single-point contact are evident upon considering the amplitude of crystal vibration at the point of contact, the undesirability of disturbing the pattern of vibration by pressure applied at this point, and the need for resilient pressure to be applied to ensure continuous contact while the crystal vibrates.

As demonstrated by the foregoing background matters, there exists a substantial need for an improved system and method for overcoming the problems and drawbacks discussed above.

SUMMARY OF THE INVENTION

This invention provides a new and advantageous system and method for providing automatic tuning without introducing complexities and drawbacks associated with a specially designed crystal as described above.

According to one definition of the invention, it resides in a system for applying ultrasound power to treat human tissue. The system comprises a transducer means having excitation electrodes, and power amplifier means for responding to an oscillating signal to supply electrical power to the transducer means via a connection to the excitation electrodes. The transducer means and the power amplifier means have a power-conversion-efficiency characteristic that is a function of the frequency of the oscillating signal and an acoustic load on the transducer means. The system further includes sampled-data means for controlling the frequency of the oscillating signal. The sampled-data means includes timing means for defining alternating sample and hold timing intervals. Means are provided in the sampled-data means for producing a frequency-control signal having a magnitude that varies during each sample interval and that remains essentially constant during each hold interval. Further means provided in the sampled-data means include means for supplying the oscillating signal to the power amplifier means, which includes variable frequency oscillator means that oscillates at a frequency determined by the frequency-control signal. The means for producing the frequency-control signal includes peak-detecting means operative during each sample interval for setting the magnitude of the frequency-control signal so that throughout the ensuing hold interval, the transducer means and the power amplifier means operate with essentially peak-power-conversion efficiency. One of the advantages of a system according to the invention is that a single coax cable can be provided for effecting an electrical connection between the two-electrode crystal transducer and the power amplifier means in a control unit.

According to another definition of the invention, it resides in apparatus for supplying electrical power to an ultrasound-power generating crystal transducer that has a pair of excitation electrodes and that is subjected to varying acoustic loads. The apparatus comprises switching circuit means having first and second inputs and first and second outputs, and including active devices that switch on and off at a rate determined by the frequency of an oscillating signal applied to the first input, circuit means cooperating with the active devices to energize the crystal via a connection between the first output and the excitation electrodes so that the level of electrical power supplied to the crystal is controlled by the magnitude of a variable supply voltage applied to the second input, and means for producing a current-representing signal, representative of the magnitude of current supplied to energize the crystal. The apparatus further comprises sampled-data means for controlling the frequency of the oscillating signal, which includes timing means for defining alternating sample and hold timing intervals. Means are provided in the sampled-data means for producing a frequency-control signal having a magnitude that varies during each sample interval and that remains essentially constant during each hold interval. Further, means are provided for supplying the oscillating signal to the first input of the switching circuit means, which includes variable frequency oscillator means that oscillates at a frequency determined by the frequency control signal. Further with respect to the means for producing the frequency control signal, it includes peak-detecting means operative during each sample interval for recording the magnitude of the frequency-control signal that corresponds to a peak in the current-representing signal so that throughout the ensuing hold interval the recorded peak value determines the frequency of the oscillating signal.

According to another definition of the invention, it resides in a method for tuning an energizing signal for an ultrasound-generating crystal. The method comprises producing a frequency-control signal so that during recurring sample intervals the frequency-control signal defines a slope and during alternately recurring hold intervals, the frequency-control signal defines an essentially constant value. The method further includes applying the frequency-control signal to a variable-frequency oscillator to control the frequency of the energizing signal so that during each sample interval the frequency of the energizing signal varies for a frequency scan embracing the resonant frequency of the crystal, and during each hold interval, the frequency of the energizing signal remains essentially constant. The method further comprises detecting a peak in the magnitude of current flowing to the crystal during the frequency scan and recording the frequency-control signal corresponding to the peak as the essentially constant value for the ensuing hold interval.

The foregoing and other novel and advantageous features of the present invention are described in detail below and set forth in the appended claims.

BRIEF DESCRIPTION OF THE DRAWINGS

FIG. 2 is a plan view of the rear face of a crystal suitable for use in the preferred embodiment;

FIG. 3 is an elevation view taken along the line 3—3 of FIG. 2;

FIG. 4 is an enlarged fragmentary, cross-sectional view taken along the line 4—4 of FIG. 2;

FIG. 5 is a schematic diagram showing an equivalent circuit for a crystal and an impedance-matching transformer that is coupled between the crystal and coax cabling that is used to connect an ultrasound power applicator to an RF power driver in the preferred embodiment;

FIG. 10 is a flow chart of operations involved in a an overall frequency-scanning operation that includes both gross tuning and fine tuning;

DETAILED DESCRIPTION

Figure 1:
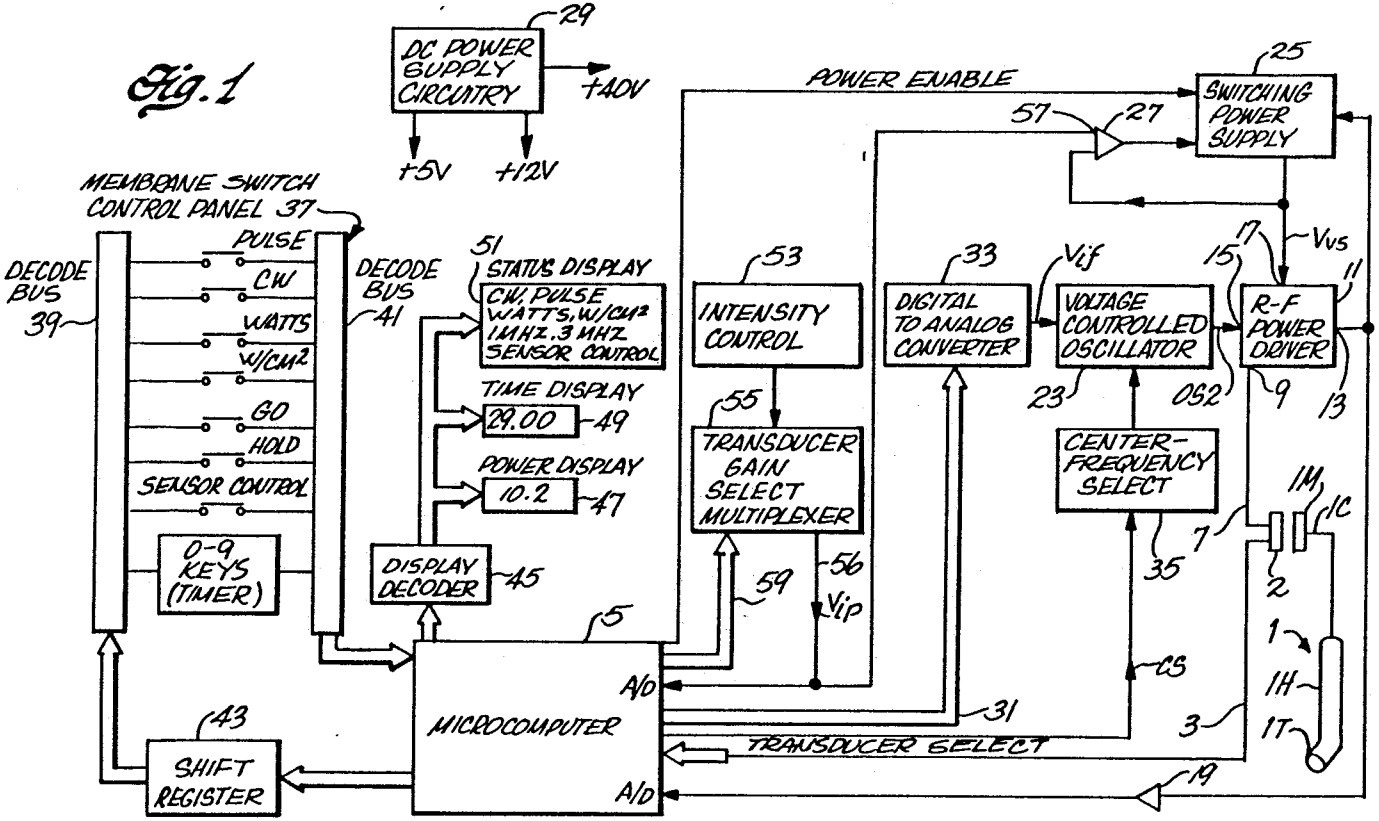
FIG. 1 is an overall block diagram of the presently preferred embodiment of a system according to this invention.

With reference to the overall block diagram of FIG. 1, a hand-held applicator is generally indicated at 1. Preferably, applicator 1 has the construction disclosed in the above-referenced, concurrently-filed, commonly-assigned patent application, and comprises, among other things, a handle portion 1H and a transducer-housing portion IT at the front or head end of handle portion 1H. Handle portion 1H comprises an electrically-grounded metal (preferably aluminum) core having an internal passageway that extends from the rear end to an internally-threaded receptacle or recess at the front end, and an outer plastic casing. Transducer-housing portion 1T comprises a dished electrically conductive member that is externally-threaded to mate the internally-threaded receptacle.

Applicator 1 includes a coax cable 1C that terminates in a multipin connector 1M that plugs into a mating connector 2 of a control unit. A desirable but not essential feature for an applicator involves providing means for defining a digitally-coded transducer select signal. That is, the same control unit can be used with any of several different replaceable applicators, each of which can contain a different crystal having characteristics appropriate for particular types of treatment. FIG. 1 shows a three-conductor bus 3 extending from connector 2 for use in an embodiment that incorporates this desirable feature. Bus 3 provides for carrying the digitally-coded transducer select signal that provides information as to whether any applicator is connected to the control unit, and if so, which type.

A microcomputer 5 receives the transducer select signal, and numerous other signals described below to perform various processing operations described below.

Suitably, microcomputer 5 is a single-chip, 8-bit microcomputer which is manufactured and sold by various companies under the designation MC68705R, and which is described in a book titled "Single-Chip Microcomputer Data," published by Motorola, Inc., 1984. This singlechip microcomputer includes an instruction processor with a standardized instruction repertory that is consistent with other microprocessing instruction processors in an M6800 family, and further includes a burnable, programmable read-only memory (PROM), a RAM memory, numerous I/O features, an analog-to-digital (A/D) converter, an on-chip clock, and programmable timing circuitry. This suitable single-chip microcomputer is provided in a package having forty pins (not individually shown) including pins that are assigned to A, B, and C port I/O lines and to interrupts as designated in the published literature for this microcomputer. The conductors of bus 3 are connected to the pins designated $\overline{\text{INT}}$, PD6/$\overline{\text{INT}}$2, and PD7 in such published literature.

A coax cable 7 in the control unit is connected to connector 2. Coax cable 7 has a center conductor, a grounded shield conductor, and an insulating sleeve. When connector 1M is plugged into connector 2, the center conductor of coax cable 7 is connected to the center conductor of coax cable 1C, and the grounded shield conductor of coax cable 7 is connected to (and grounds) the shield conductor of coax cable 1C.

Within connector 1M, at least one pin of a set of three pins of connector 1M is electrically connected (by a shorting strap) to the shield conductor of coax cable 1C, so that at least one of the set of three pins is also grounded while connector 1M is plugged into connector 2. Each of the three conductors of bus 3 is connected via connector 2 to a respective one of the three pins, so that at least one of the conductors of bus 3 is grounded while connector 1M is plugged into connector 2. The absence of a ground on any of the conductors of bus 3 represents a condition in which no applicator is plugged into the control unit. The use of selected shorting straps provides a code as to which type of applicator is plugged into the control unit.

One end of the center conductor of coax cable 7 is connected to a power output terminal 9 of an RF power driver 11 that also has an analog current-representing signal output terminal 13, and two input terminals 15 and 17. The current-representing signal defined at terminal 13 is amplified by an amplifier 19 to provide an analog signal to microcomputer 5. The internal A/D converter within microcomputer 5 responds to this analog signal.

Input terminal 15 of RF power driver 11 is connected to receive an oscillating signal (OS2) from a voltage-controlled oscillator (VCO) 23, and input terminal 17 is connected to receive a variable DC supply voltage from a feedback-controlled, switching power supply 25. A comparator circuit arrangement 27 is part of a feedback loop for controlling the magnitude of the variable supply voltage.

As to the source of power, the control unit includes conventional DC power supply circuitry 29 for rectifying 110 volt AC power, and for filtering, etc. to produce 5V (regulated), +12V (regulated), and +40V (unregulated). The +40V unregulated supply is for switching power supply 25; the regulated supplies are for various integrated circuits in the control unit.

As stated above, microcomputer 5 includes programmable timing circuitry; this includes an internal 8-bit timer responsive to the on-chip clock to provide for cyclically defining timing intervals. As used in the preferred embodiment, this internal circuitry of microcomputer 5 provides for alternately defining sample and hold timing intervals. Once each second, there is a sample timing interval that has a duration of approximately 25 milliseconds, and there ensues a hold interval that has a duration of approximately 975 milliseconds. As explained more fully below, a fine-tuning, frequency-scanning operation is carried out during each such approximately 25-millisecond long sample interval. Each such fine-tuning, frequency-scanning operation results in the recording of a value that is held throughout the ensuing hold timing interval and used to keep the frequency of the OS2 signal produced by VCO 23 essentially constant during the hold interval. Further, on a once-per-minute basis, the sample timing interval is defined to provide a longer duration during which a gross-tuning, frequency-scanning operation is carried out immediately before the fine-tuning frequency scanning operation.

A multi-bit bus 31 connects microcomputer 5 to a digital-to-analog converter (DAC) 33, which provides a $V_{if}$ signal to control the frequency of operation of VCO 23. Suitably, DAC 33 is implemented by an integrated circuit manufactured and sold by various companies under the designation AD558. Eight of the bits carried by bus 31 are data bits defined at the port B pins of microcomputer 5; two other bits are control bits defined at two of the port A pins of microcomputer 5 and provide for performing conventional chip enable and chip select functions. DAC 33 includes latch circuits which copy and hold the $V_{if}$ signal which microcomputer 5 sends to it via bus 31.

The center frequency of VCO 23 is automatically selected in accord with whether a 1 Mhz crystal or a 3 Mhz crystal is being used. As explained in more detail below, RF power driver 11 includes flip flop circuitry for dividing the VCO frequency by two; accordingly, the nominal or center frequency of the oscillating signal (OS2) supplied by VCO 23 is 2 Mhz or 6 Mhz, depending upon which crystal is being used. Circuitry 35 associated with VCO 23 for implementing the selection function is controlled by an 1-bit control signal CS that microcomputer 5 provides on one of its port C pins.

Many doctors and other medical personnel desire to have flexibility in selecting numerous modes of operation and various ultrasound power level outputs. Accordingly, the control unit includes a multi-switch membrane-switch control panel that is generally indicated at 37.

A six-bit wide decode bus 39 and a four-bit wide decode bus 41 are associated with membrane switches of control panel 37, and which communicate with microcomputer 5. In the case of decode bus 39, it communicates with microcomputer 5 through a shift register 43 in a conventional manner to scan the status of the membrane switches.

Further, the control unit includes means for providing a display. The display means includes a conventional display decoder 45 that is responsive to an output of microcomputer 5 and that controls a power level display 47, a time display 49, and a status display 51. Suitably, display decoder 45 is implemented by an integrated circuit manufactured and sold by various companies under the designation IMC7218B. Power level display 47 comprises three conventional 8-segment digit display devices, and provides a three-digit indication as to the ultrasound power level being used. Time display 49 comprises four conventional 8-segment digit display devices, provides a four-digit indication concerning time of treatment. Status display 51 comprises seven conventional light emitting diodes each of which provides an individual indication as to a miscellaneous status matter such as whether a continuous wave mode of operation has been selected, or whether a pulse mode of operation has been selected, and so forth.

As to controlling the level of ultrasound power to be applied, the control unit includes a manually-operated intensity control 53, suitably implemented by a conventional potentiometer circuit arrangement, and associated analog multiplexing circuitry 55. Under control of microcomputer 5, multiplexing circuitry 55 propagates a selected one of a group of analog signals as a $V_{ip}$ input signal that is carried by a conductor 56 to an input terminal 57 of comparator circuit arrangement 27 and to a terminal of microcomputer 5. One of this group of analog signals has a predetermined value, independent of intensity control 53, for causing a low power level to be used during a sample operation. Each of the remaining analog signals in this group is controlled by the manual setting of intensity control 53. Microcomputer 5 selects one of these remaining analog signals during the hold operation, the selected one being dependent upon which applicator is plugged into the control unit. A 3-bit wide bus 59 carries the digital selection signals from microcomputer 5 to multiplexing circuitry 55.

With reference to FIGS. 2–4, there will now be described features of a representative crystal transducer 61 that can be used in the preferred embodiment. Crystal transducer 61 comprises a barium titanate crystal 63 that is generally disk shaped, having a diameter of 10 centimeters (cm), and having front and rear circular faces. On the rear face, as best shown in FIG. 2, an excitation electrode 65 is defined by a relatively thin, flat silver coating that suitably is silk-screened onto the crystal face. Excitation electrode 65 is used the high-voltage excitation electrode, and excitation electrode 67 is used as the ground excitation electrode.

Excitation electrode 67 is cup shaped, and includes a thin, flat circular portion 71 covering all of the front face of crystal 63, and includes a cylindrical portion 73 covering the periphery of crystal 63. Excitation electrode 67 is also suitably silk screened on. Alternatively, the front excitation electrode can be defined just by a cylindrical coating. In any case, crystal 63 further includes an insulating coating 75 of cobalt blue glass. Coating 75 covers all the front face and a portion of the periphery. In accord with suitable conventional techniques, the silver coatings are silk screened on, then a firing cycle is carried out, then glass frit particles are applied, then two consecutive firing cycles are carried out.

With reference to FIG. 5, an equivalent circuit 80 for the crystal is shown as including two parallel branches between the high-voltage excitation electrode 65 and the ground excitation electrode 67. One of the parallel branches comprises, in series, an equivalent inductance 81, an equivalent capacitance 83, and an equivalent resistance 85. The other parallel branch consists of an equivalent shunt capacitance 87.

The resistance of equivalent resistance 85 depends upon the acoustic load upon the crystal. In a theoretical case in which the value of equivalent resistance 85 is assumed to be zero, the resonant frequency of the crystal is the frequency at which the magnitude of the inductive reactance of equivalent inductance 81 is equal to the magnitude of the capacitive reactance of equivalent capacitance 83. In such theoretical case, the input impedance of the crystal would be zero ohms at the resonant frequency. The crystal also has an anti-resonant frequency, i.e., a frequency at which its input impedance is maximum. The anti-resonant frequency is higher in the spectrum than the resonant frequency.

Changes in the acoustic load that cause the resistance value of equivalent resistance 85 to increase have the effect of reducing the resonant frequency and increasing the minimum input impedance (i.e., the input impedance at resonance). Representative exemplary values are 22 ohms input impedance for resonance under conditions of 2% air coupling, and 28 ohms input impedance for resonance under conditions of 30% air coupling. These values are exemplary for a 10 cm., 1 Mhz crystal. Different absolute values apply to other crystals such as a 10 cm., 3 Mhz crystal, but the percentage change in input impedance is quite similar.

As also shown in FIG. 5, a matching transformer 91 is coupled between the excitation electrodes and coax cable 1C. Matching transformer 91 is an autotransformer having a winding 93 and a winding 95. In one embodiment, winding 93 has 13 turns and winding 95 has 23 turns. Matching transformer 91 includes a toroidal core of ferrite material having a broad bandwidth such that its magnetic permeability is substantially constant throughout a frequency range up to about 10 Mhz. Suitable such ferrite material is manufactured and sold by Ferroxcube Linear Materials and Components under the designation 4C4.

By selecting an appropriate number of turns for windings 93 and 95 in accord with known impedance-matching techniques, it is possible to standardize the input impedance presented at nodes 97 and 99 regardless of which particular crystal, whether 1 Mhz, 3 Mhz, or otherwise, is being used. A suitable standard input impedance is 50 ohms nominal (i.e., at resonance for a typical acoustic load).

In the preferred embodiment, matching transformer 91 is mounted on a relatively small circular printed circuit board contained in the recess at the end of handle portion 1H, and coax cable 1C extends through the passageway within the core of handle portion 1H. The center conductor of coax cable 1C is connected to node 97. The common node defined at the junction of windings 93 and 95 is preferably connected to the rear crystal excitation electrode via a wave washer as shown and described in the in the above-referenced, concurrentlyfiled, commonly-assigned patent application. The grounded shield conductor of coax cable 1C is connected to node 99. The front excitation electrode is grounded because metal-to-metal contacts ensure that the dished electrically conductive member of transducer-housing 1T, the electrically conductive core of handle portion 1H, and node 99 are all maintained at ground potential.

Figure 6:
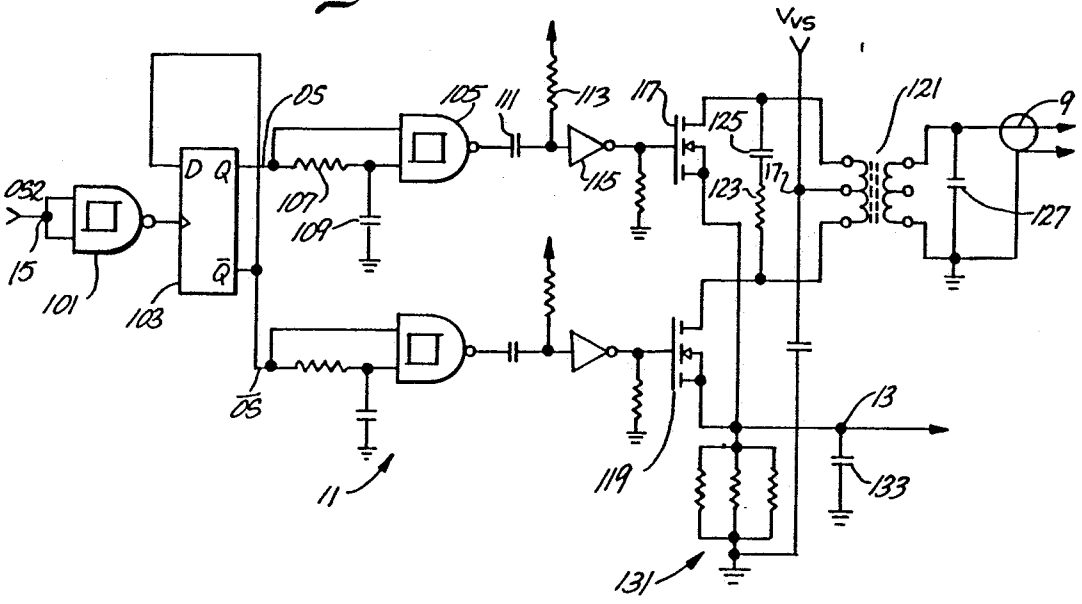
FIG. 6 is a block and schematic diagram showing circuitry for implementing the RF power driver used in the preferred embodiment.

With reference to FIG. 6, there will now be described circuitry for RF power driver 11. At its first input terminal 15, RF power driver 11 receives the oscillating signal (OS2). At its second input terminal 17, RF power driver 11 receives a feedback-loop controlled variable power supply voltage $V_{VS}$ from switching power supply 25 (FIG. 1). At its first output terminal 9, RF power driver 11 supplies the electrical drive signal that is coupled via the center conductor of coax cable 7 to matching transformer 91 (FIG. 5). At its second output terminal 13, RF power driver 11 provides the current-sense signal that is amplified by amplifier 19 (FIG. 1) and coupled to microcomputer 5 for its internal A/D converter to produce a digitally-coded current-representing signal representative of the magnitude of current flowing through the crystal.

An integrated-circuit Schmitt trigger 101 responds to the oscillating signal at input terminal 15 and provides a trigger signal to the clock input of a D-type flip flop 103. The $\overline{Q}$ output of flip flop 103 is connected to its D input so that each of the complementary signals OS and $\overline{OS}$ produced at the Q and $\overline{Q}$ outputs of flip flop 103 oscillates at one-half the frequency of the oscillating signal OS2 provided at input terminal 15.

The Q output of flip flop 103 is directly connected to one input of an integrated-circuit Schmitt trigger 105, and is coupled to the other input via a resistor 107 which cooperates with a capacitor 109 to form a R-C delay circuit. Suitable values for resistor 107 and capacitor 109 are 1K ohm and 33 picofarads (pf). The output signal of Schmitt trigger 105 is a generally square-wave signal in which each negative half-cycle is slightly shorter in duration than the ensuing positive half-cycle.

A differentiating circuit comprising a capacitor 111 and a resistor 113 responds to the signal produced by Schmitt trigger 105 and provides pulses to an inverter 115. On each negative-going edge of the generally square-wave signal produced by Schmitt trigger 105, inverter 115 provides a positive-going pulse to a field effect transistor (FET) 117.

The circuitry for coupling the signal from the Q output of flip flop 103 to FET 117 is replicated by circuitry for coupling the complementary signal produced by the $\overline{Q}$ output of flip flop 103 to a FET 119.

The drain electrode of FET 117 is connected to one end of a center-tapped primary winding of a transformer 121; the drain electrode of FET 119 is connected to the opposite end of the primary winding. An R-C circuit, comprising a resistor 123 and a capacitor 125, is connected across the primary winding, and a capacitor 127 is connected across the secondary winding. Suitable values for these components are 91 ohms for resistor 123, 82 pf for capacitor 125, and 390 pf for capacitor 127; these suitable values reduce the magnitudes of harmonic components so that the signal the secondary winding of transformer 121 supplies at terminal 9 is generally sinusoidal.

The source electrode of FET 117 and the source electrode of FET 119 are each connected to terminal 13. Three resistors, each having a resistance value of 1 ohm and a power dissipation rating of 1 watt, are connected in parallel with each other as generally indicated at 131 and in parallel with a capacitor 133, to provide for defining an analog signal at terminal 13 that represents the magnitude of the current being supplied to the crystal. This magnitude depends on the magnitude of the variable DC supply voltage applied via terminal 17 to the center tap of the primary winding of transformer 121 and on the relationship between frequency of the drive signal at terminal 9 and the resonant frequency of the crystal.

In combination, RF power driver 11, impedance matching transformer 91, and crystal transducer 61 have a power-conversion-efficiency characteristic that is a function of the frequency of the oscillating signal (OS) and the acoustic load on crystal transducer 61. Achieving high efficiency is important. In a given case, it is desirable to deliver up to about 20 watts of power to a patient. If the frequency of the electrical drive signal coupled to crystal transducer 61 equals the resonant frequency, then the alternating voltage across the crystal transducer is in phase with the alternating current flowing through it; otherwise there is a phase shift between them. Such a phase shift results in an undesirable power loss in RF power driver 11. In this regard, an ideal situation would involve each of the FETs 117 and 119 switching instantaneously from 0 ohms ON impedance to an open-circuit OFF impedance. In such an ideal situation, neither FET would dissipate any wasted power and would not heat up. As a practical matter, the ON impedance of an FET is about 0.3 ohms, and is even higher during transient conditions (i.e., the FET does not switch instantaneously). Because of these practical matters, the power-conversion efficiency can be as low as about 20% to 25% in operation off the resonant peak. By tuning the oscillating signal to provide for operation at the resonant peak, a power-conversion efficiency of about 50% can be achieved.

Figure 7:
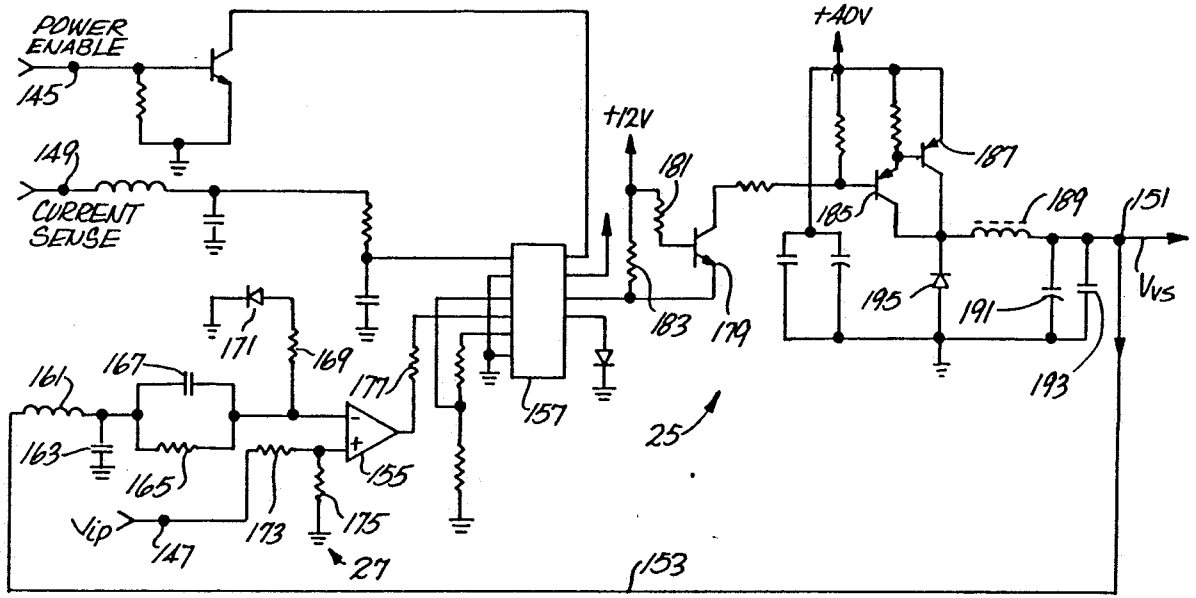
FIG. 7 is a block and schematic diagram showing feedback-controlled, switching power-supply circuitry for supplying a variable DC supply voltage to the RF power driver used in the preferred embodiment.

With reference to FIG. 7, there will now be described circuitry for providing the variable DC power supply voltage $V_{VS}$. The circuitry shown in FIG. 7 implements switching power supply 25 and comparator circuit arrangement 27. An input terminal 145 receives a power enable logic control signal. Microcomputer 5 provides the power enable signal to turn switching power supply 25 on and off during pulse mode of operation. Suitably, the pulse repetition period is ten milliseconds (10 ms), during which power is on suitably for a 2 millisecond (ms) interval, and off for an 8 ms interval. A terminal 147 receives the analog input signal $V_{ip}$. Under selection control of microcomputer 5, analog multiplexing circuitry 55 (FIG. 1) provides the $V_{ip}$ signal to determine the level of the variable DC power supply voltage. A terminal 149 receives the current sense signal from terminal 13 of RF power driver 11. If the magnitude of the current sense signal exceeds a predetermined value, switching power supply 25 turns off. At a terminal 151, switching power supply 25 provides the variable DC power supply voltage which is applied to terminal 17 of RF power driver 11 and is fed back via a conductor 153 as shown in FIG. 7 to form a feedback loop.

Within the feedback loop there is a filter circuit that is coupled between conductor 153 and the inverting input of an integrated circuit comparator 155 that provides a logic control signal to an integrated circuit voltage regulator 157. A suitable voltage regulator chip is manufactured and sold by various companies under the designation LM723CN.

The above-mentioned filter circuit comprises an inductor 161, a capacitor 163, a resistor 165, and a capacitor 167. A resistor 169 and a diode 171 are connected in series from the inverting input of comparator 155 to ground. The $V_{ip}$ signal is coupled through a resistor divider network to the non-inverting input of comparator 155. The resistor divider network comprises a resistor 173 and a resistor 175.

The output of comparator 155 is coupled through a resistor 177 to one of the inputs of voltage regulator 157. When the logic level of the signal produced at the output of comparator 155 is high, the logic level of the output signal produced by voltage regulator 157 is low, whereby a transistor 179 conducts. When the logic level of the signal produced at the output of comparator 155 is low, the logic level of the output signal produced by voltage regulator 157 is high, whereby transistor 179 is turned off. Base current is provided for transistor 179 through a resistor 181. A biasing resistor 183 is connected between the emitter of transistor 179 and the +12 volt power supply voltage.

While transistor 179 conducts, it provides base current for a transistor 185 to cause it to conduct current from the +40V unregulated supply. When transistor 185 conducts, it causes a transistor 187 to conduct also, and the two collectors are connected together so that the collector currents of these two transistors combine. A filter circuit is connected between the common collectors of transistors 185 and 187 to ground. This filter circuit comprises an inductor 189, a capacitor 191 and a capacitor 193. Suitable values for these filter circuit components are: 500 microhenries for inductor 189, 10 microfarads for capacitor 191, and 0.1 microfarads for capacitor 193. A diode 195 is connected with its cathode connected to the common collectors of transistors 185 and 187 and with its anode connected to ground. This diode prevents negative spikes from occurring at the common collector point.

Figure 8:
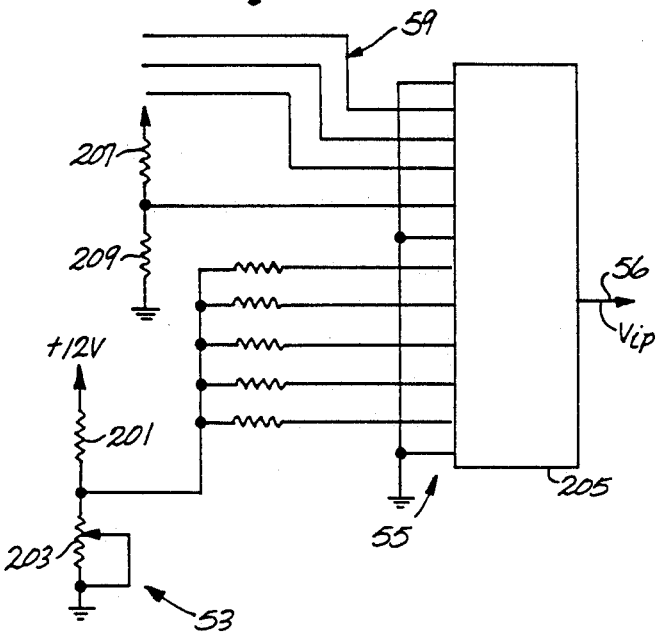
FIG. 8 is a block and schematic diagram showing circuitry for implementing a manually-operated intensity control, and associated analog multiplexing circuitry used in the preferred embodiment.

With reference to FIG. 8, there will now be described circuitry for implementing manually-operated intensity control 53 and analog multiplexing circuitry 55.

Manually-operated intensity control 53 includes a resistor 201 having one end connected to a +12V supply resistor 201 has its opposite end connected to one end of a potentiometer 203. The opposite end of potentiometer 203 is grounded. The output of intensity control 53 is coupled through five resistors to five corresponding analog input terminals of an integrated circuit analog multiplexer 205. Suitably, analog multiplexer 205 is implemented by an integrated circuit manufactured and sold by various companies under the designation CD4051BM. A sixth analog input terminal of analog multiplexer 205 is connected to a resistor divider network comprising resistors 207 and 209. The analog signal on this sixth analog input terminal determines the low power level used during a frequency-scanning operation. Digital selection signals carried by three-bit wide bus 59 determine which analog input signal propagates to conductor 56 as the $V_{ip}$ signal.

Figure 9:
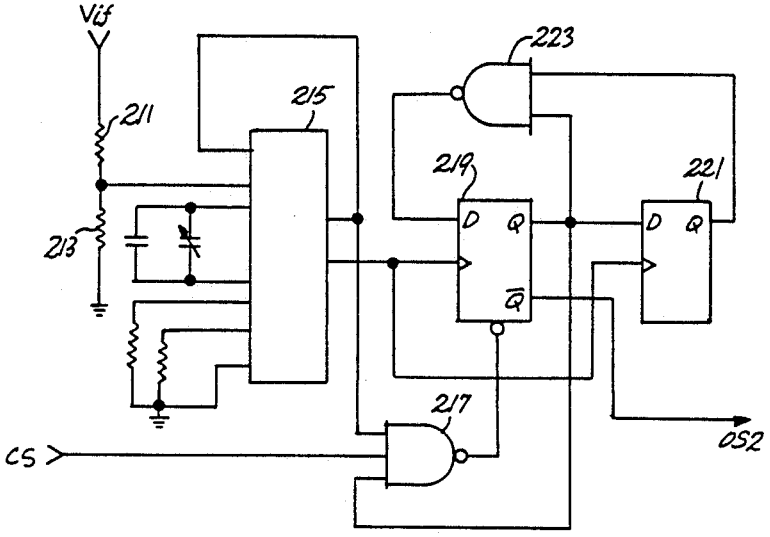
FIG. 9 is a block and schematic diagram showing circuitry for implementing a voltage controlled oscillator (VCO) and an associated center frequency selector used in the preferred embodiment.

With reference to FIG. 9, there will now be described circuitry for implementing VCO 23 and associated center-frequency selector circuitry 35.

The $V_{if}$ signal is coupled through a resistor divider network comprising resistors 211 and 213 to an integrated circuit VCO 215. A suitable such integrated circuit is manufactured and sold by various companies under the designation 74HC4046. VCO chip 215 is connected to tuning capacitors and biasing resistors in a conventional manner; one of its outputs is connected to one input of a 3-input NAND gate 217; and another of its outputs is connected to the clock input of a D-type flip flop 219. The Q output of flip flop 219 is connected to another input of NAND gate 217. The third input of NAND gate 217 receives the CS signal from microcomputer 5.

The Q output of flip flop 219 is also connected to the D input of a D-type flip flop 221, and to one input of a 2-input- NAND gate 223. The other input of NAND gate 223 is connected to the Q output of flip flop 221. The output of NAND gate 223 is connected to the D input of flip flop 219. The oscillating signal (OS2) is produced by the $\overline{Q}$ output of flip flop 219.

With reference to FIGS. 10–13, there will now be described operations carried out under control of microcomputer 5 to set the magnitude of the $V_{if}$ signal to be held by latches within DAC 33 throughout a hold interval.

Figure 11:
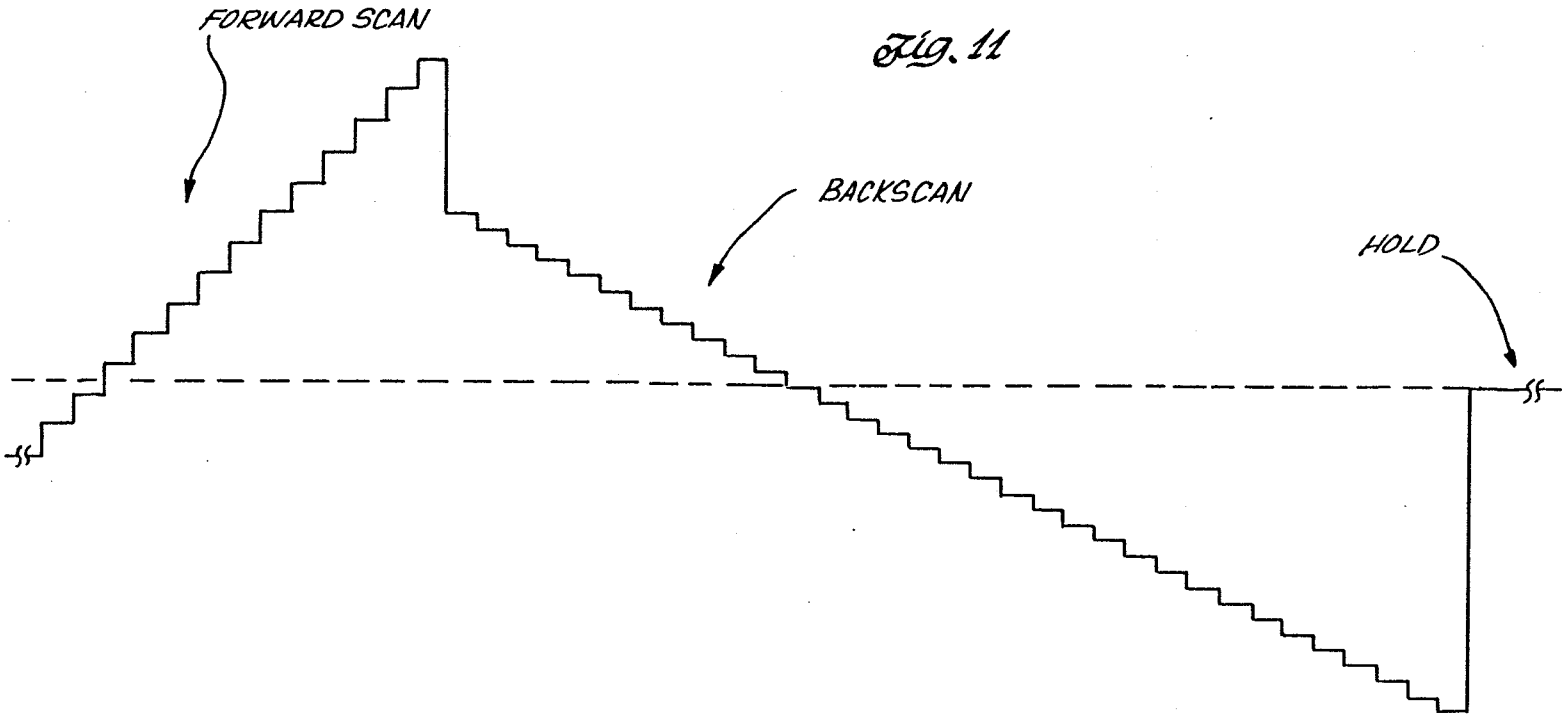
FIG. 11 is a timing diagram of the overall frequency-scanning operation of FIG. 10.

FIG. 10 shows, in flow chart form, operations that are carried out in execution of a center frequency locate (CFLOCATE) routine. FIG. 11 shows, in timing diagram form, how these operations result in a forward scan, followed by a backscan, and then a hold interval. During the forward scan, the $V_{if}$ signal is stepped to define an increasing staircase waveform. During the backscan, the $V_{if}$ signal is stepped to define a decreasing staircase waveform. During the hold interval, the $V_{if}$ signal is held constant by the latch circuits within DAC 33.

Execution of the CFLOCATE routine involves calls and returns from several routines including a STEPVCO routine, a SHIFTAV routine, an ANALYZE routine, a FAVPEAK routine, and a SCANBKWD routine.

In the course, of executing these routines, microcomputer 5 uses locations of its random access memory (RAM) to retain records referred to herein as history records and average records. The history records are retained in a history table and the average records are retained in an average table. Each history record is in the nature of a raw data point concerning the magnitude of the current-sense signal corresponding to a given step of the increasing staircase. Each average record has a running average value. In the preferred embodiment, eight history records at a time are retained in the history table, the oldest one being discarded each time a new history record is entered. Likewise, eight average records are retained in an average table, the oldest one being discarded each time a new average record is entered. Thus, there is a one-to-one mapping between the number of history records and the number of average records. The value of each average record is the average of the values of the corresponding history record and the seven earlier-recorded history records.

Also, in the course of executing these routines, the microcomputer 5 uses flags for flow control. One such flag is the carry flag.

As shown in FIG. 10, the CFLOCATE routine begins in block 300. In this block, microcomputer 5 initializes the history table and the average table and the flags used for flow control.

Suitable assembly-language code for the initialize block 300 is set forth below:

```
          CLRX
          LDA   #ØØH
CLRTBL0   STA   AVERAGE, X
          STA   HISTORY, X
          INCX
          CPX   #8
          BEQ   CLRTBL1
          BRA   CLRTBLØ
CLRTBL1   CRX
          CLC
          JSR   LOWPWRS
          CLR   FREQVCO
          CLR   FSWPCNT
          BCLR  Ø, FLGWRD
```

As to the JSR instruction set out above, this calls a low power set (LOWPWRS) routine. Suitable assembly-language code for the LOWPWRS routine is set forth below:

```
BCLR    4, PORT A
BCLR    5, PORT B
BCLR    6, PORT A
BCLR    6, PORT C
RTS
```

After the foregoing initialization operations, the flow proceeds to enter a loop 302 comprising blocks 304, 306, 308 and 310.

Suitable assembly-language code for the STEPVCO routine of block 304 is set forth below:

```
STEPVCO   LDA   FREQVCO    ;Get the current VCO setting
          ADD   #VCOINC    ;Advance the setting by the step value
          BCS   STEPV2     ;If maximum exceeded set carry and exit
          STA   FREQVCO    ;Save for later on next pass
STEPVCO   STA   PORTB      ;Put FREQVCO value out on port B to DAC/VCO
          BCLR  2,PORTA    ;Enable DAC input circuitry
          BCLR  3,PORTA    ;Lower clock to DAC input
          BSET  3,PORTA    ;Raise clock to DAC and set DAC input latches
          BSET  2,PORTA    ;Disable DAC input circuitry
          LDA   #RSPDLY    ;Get the DAC/VCO response delay value
STEPV1    DECA             ;Count down the delay value
          BNE   STEPV1     ;Loop till the delay has expired
          JSR   ANALOGO    ;Go get low power byte
          STA   WATTB      ;Store value for processing
          CLC              ;Clear carry for step done
          RTS
STEPV2    SEC              ;Set the carry to indicate that the range is exceeded
          RST              ;Exit with range error
```

As to the JSR instruction set out above, this calls an analog-to-digital conversion routine (ANALOGO). Suitable assembly-language code for the ANALOGO routine is set forth below:

```
ANALOG0   LDA    #WATTIN     ;Get value of lowest byte conversion
          STA    ADCSR       ;Start conversion
          BRA    ANALOG
ANALOG1   LDA    #CURRIN     ;Get value of second byte conversion
          STA    ADCSR       ;Start conversion
          BRA    ANALOG
ANALOG2   LDA    #INTSIN     ;Get value for intensity conversion
          STA    ADCSR       ;Start conversion
          BRA    ANALOG
ANALOG3   LDA    #TESTIN     ;Get value for test flag
          STA    ADCSR       ;Start conversion
ANALOG    BRCLR  7,ADCSR,$   ;Wait for whatever conversion is running to finish
          LDA    ARR         ;Get the result from the result register
          RTS
```

Suitable assembly-language code for the SHIFTAV routine of block 306 is set forth below:

```
SHIFTAV
          CLRSX               ;Starting point pointer in history table in ram
SHIFT1    LDA    HISTORY+1,X  ;Get byte to move
          STA    HISTORY, X   ;Move the byte left in the table
          INCX                ;Advance the pointer
          CPX    #7           ;Test for done with history shift
          BNE    SHIFT1       ;Loop here till all of the history table is finished
SHIFT2    LDA    WATTB        ;Get the current power reading LSB
          STA    HISTORY+7    ;Put into the table first position
          CLRX                ;Starting point pointer in average table in ram
SHIFT3    LDA    AVERAGE+1,X  ;Get byte to move
          STA    AVERAGE,X    ;Move the byte left in the table
          INCX                ;Advance the pointer
          CPX    #7           ;Test for done with average shift
          BNE    SHIFT3       ;Loop here till all of the average table is finished
SHIFT4    CLR    AVERAGE+7
          CLRX                ;Starting point pointer in history table to average
SHIFT5    LDA    HISTORY,X    ;Get the LSB of history
          ADD    SUM+1        ;Add LSBs and set carry if applicable
          STA    SUM+1        ;Save as total cum
          BOC    SHIFT5A      ;If carry is set then increment high byte
          INC    SUM          ;Add with carry from LSB
          CLC                 ;Reset the carry for the next addition
SHIFT5A   INCX                ;Advance the pointer to the next place in history table
          OPX    #8           ;Test for cumulation of history taken
          BNE    SHIFT5       ;Loop till all history entries cumulated
SHIFT6    CLC                 ;Clear the carry as it will be part of the shift to divide
          ROR    SUM          ;Divide by eight with rotates to the right
          ROR    SUM          ;Divide by eight with rotates to the right
          ROR    SUM+1
          CLC                 ;Clear the carry as it will be part of the shift to divide
          ROR    SUM          ;Divide by eight with rotates to the right
          ROR    SUM+1
          LDA    SUM+1
          STA    AVERAGE+7
          RTS                 ;Exit with all tables updated
```

Figure 12:
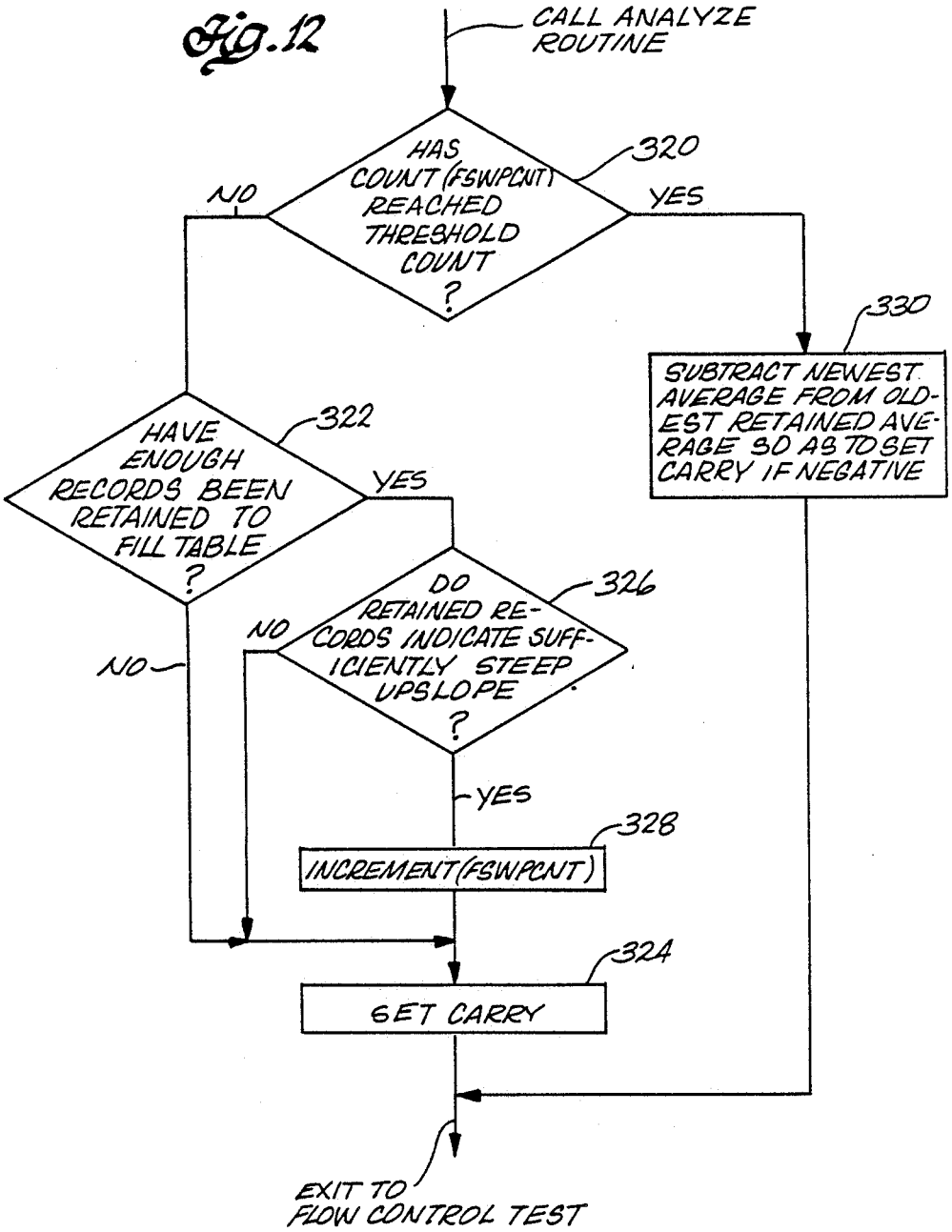
FIG. 12 is a flow chart of operations for a routine (referred to as ANALYZE) carried out in the preferred embodiment.

With respect to the ANALYZE routine of block 308, reference is made to FIG. 12 for a more detailed flow chart. Briefly, the function of the ANALYZE routine is to determine on the basis of an analysis of the retained records in the average table whether the increasing staircase depicted in FIG. 11 has passed the resonant frequency (at which the magnitude of the current sense signal peaks) which is where the optimum power output occurs from the crystal.

When plotted as a function of frequency, the current sense signal has numerous minor peaks that are each preceded by a shallow upslope. There is a major peak, preceded by a steep up slope, corresponding to the resonant frequency. The ANALYZE routine includes a test to determine whether the retained records in the average table indicate a sufficiently steep upslope, and, if so, the routine increments a count (FSWPCNT).

On each entry into the ANALYZE routine, block 320 is entered to determine whether the FSWPCNT has reached a threshold count. A suitable threshold count is five times. If this count has not been reached, the flow proceeds to block 322 to test whether enough records (eight in the preferred embodiment) have been retained so as to fill the table. If not, the carry flag is set as indicated in block 324. Otherwise, the flow proceeds to block 326 to determine whether the retained records indicate a sufficiently steep upslope. If not, block 324 is immediately entered. Otherwise, the flow proceeds to block 328 in which FSWPCNT is incremented.

Upon determining in block 320 that the threshold count has been reached, the flow proceeds to block 330. If the newest average is less than the oldest average and there has been a steep upslope, it follows that a peak has been detected. As to the flow control test, this simply involves checking the carry flag. If it is set, the flow return block 304 (FIG. 10); otherwise the FAVPEAK routine block 312 is called.

Suitable assembly-language code for the ANALYZE and FAVPEAK routines are set forth below:

```
ANALYZE     LDA     FSWPCNT
            CMP     #5
            BEQ     ANAL4
            BRSET   0,FLGWRD,ANAL2
            LDA     AVERAGE
            BNE     ANAL1
            SEC
            RTS
ANAL1       BSET    0,FLGWRD
ANAL2       LDA     AVERAGE+7
            SUB     AVERAGE+4
            BCS     ANAL3
            CMP     #5
            BHS     ANAL3A
ANAL3       SEC
            RTS
ANAL3A      INC
            SEC
            RTS
ANAL4       LDA     AVERAGE
            SUB     AVERAGE+7
            RTS
FAVPEAK
            LDX     #8
            STX     XTEMP
FAVP1       LDA     AVERAGE-1,X
            STX     YTEMP
            LDX     XTEMP
            SUB     AVERAGE-1,X
            BCS     FAVP2
            LDX     YTEMP
            STX     XTEMP
FAVP2       LDX     YTEMP
            DECX
            BNE     FAVP1
            LDA     FREQVCO
            SUB     #16
            LSL     XTEMP
            LSL     XTEMP
            ADD     XTEMP
            ECC     FAVP3
            LDA     #255
FAVP3       STA     FREQVCO
            RTS
```

Upon establishment in block 312 of the start point of fine tuning, the flow proceeds to the SCANBKWD routine, block 314 (FIG. 10).

Figure 13:
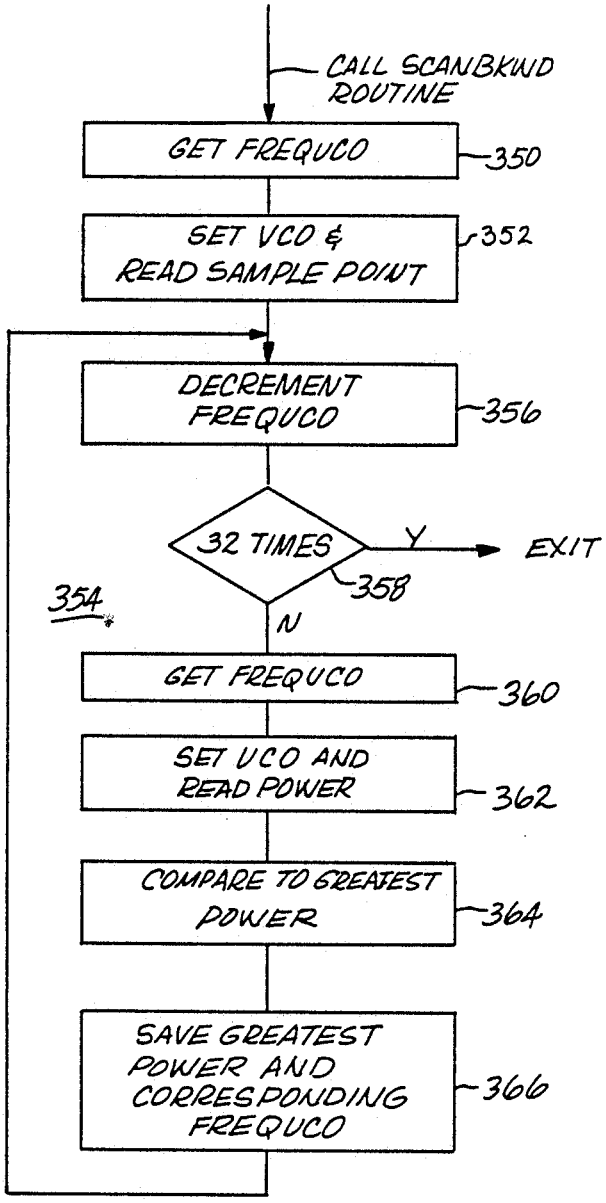
FIG. 13 is a flow chart of operations for another routine (referred to as SCANBKWD) carried out in the preferred embodiment.

As shown in FIG. 13, the SCANBKWD routine begins in block 350 by retrieving the FREQVCO value. Then in block 352, the VCO is set and the sample point is read. Then, a loop 354 is entered.

During loop 54, the optimum power level and corresponding FREQCO are determined for use in setting the V(if) to the VCO 23 during the subsequent hold interval. The operations of loop 354 are carried out 32 times in this embodiment. Each such time, the FREQVCO value is decremented (block 356), then a counter is checked (block 358) to determine whether the operations of loop 354 have been carried out 32 times. If not, block 350 is entered, and the flow proceeds through blocks 360, 362, 364, 366, and 356 again.

Suitable assembly language code for the SCANBKWD routine is set forth below.

```
BACKSCN     JSR     LOWPWRS
SCANBKWD
            LDA     FREQVCO
            STA     ATEMP
            CLRX
```

-continued

```
            JSR     STEPVO
            LDA     WATTB
            STA     YTEMP
SCANBO      DEC     FREQVCO
            BEQ     SCANB4
            INCX
            CPX     #32
            BEQ     SCANB4
            LDA     FREQVCO
            JSR     STEPVO
            LDA     WATTB
            CMP     #OFFH
            BCS     SCANB1
            JSR     ANALOG1
            CMP     TSHOLD
            BLO     SCANB1
            INC     UNLDFLG
SCANB1      SUB     YTEMP
            BCS     SCANBO
SCANB2      LDA     WATTB
            STA     YTEMP
            LDA     FREQVCO
            STA     ATEMP
SCANB3      BRA     SCANBO
SCANB4      TST     UNLDFLG
            BEQ     SCANB5
            LDA     OLDVCO
            BRA     SCANB6
SCANB5      LDA     ATEMP
            STA     OLDVCO
SCANB6      STA     FREQVCO
            STA     PORTB
            BCLR    2,PORTA
            BCLR    3,PORTA
            BSET    3,PORTA
            BSET    2,PORTA
            LDA     YTEMP
            CMP     #044H
            BLS     SCANB12
            LDA     ATEMP
            CMP     #0E6H
            BHS     SCANB12
            CMP     #039H
            BLS     SCANB12
            ADD     #16
            BVCC    SCANB7
            LDA     #255
SCANB7      STA     FREQVCO
SCANB8      JSR     XTAL2
            BRCLR   1,OUTMODE,SCANB10
            BSET    6,PORTC
SCANNB10    CLC
            RTS
SCANB12     LDA     ATEMP
            ADD     #16
            STA     FREQVCO
            LDA     ERRCNT
            CMP     #7
            BNE     SCANB13
            CLR     ERRCNT
            LDA     #84H
            STA     ERRFLG
            BSET    0,TSTFLG
            JMP     RUNLF98
SCANB13     INC     ERRCNT
            BRA     SCANB8
```

The above-described apparatus and method for tuning is presently preferred, and is exemplary of numerous equivalents within the scope of the invention as defined in the following claims.

We claim:

1. A system for applying ultrasound power to treat human tissue, which comprises:

transducer means adapted to applying ultrasound power to human tissue and having excitation electrodes;

power amplifier means for responding to an oscillating signal for providing electrical power to the transducer means via a connection to the excitation electrodes;

the transducer means and the power amplifier means having a power-conversion-efficiency characteristic that is a function of the frequency of the oscillating signal and an acoustic load on the transducer means;

sampled-data means for controlling the frequency of the oscillating signal, the sampled-data means including:

timing means for defining alternating sample and hold timing intervals;

means for producing a frequency-control signal having a magnitude that varies during each sample interval and that remains essentially constant during each hold interval;

means for supplying the oscillating signal to the power amplifier means, including variable-frequency oscillator means that oscillates at a frequency determined by the frequency-control signal; and the means for producing the frequency-control signal including peak-detecting means operative during each sample interval for setting the magnitude of the frequency-control signal so that throughout the ensuing hold interval the transducer means and the power amplifier means operate with essentially peak-power-conversion efficiency.

2. A system according to claim 1, wherein the transducer means includes a generally disk-shaped crystal, and each excitation electrode substantially covers a respective face of the crystal.

3. A system according to claim 1, and including a shielded cable for connecting the power amplifier means to the excitation electrodes.

4. A system according to claim 3 wherein the shielded cable is a coax cable.

5. A system according to claim 1, and further including transformer means for providing a matching impedance to the power amplifier and having an input connected to the power amplifier means, and an output connected to the excitation electrodes.

6. A system according to claim 1, wherein the peak-detecting means includes circuit means for producing a current-representing signal for representing the magnitude of the current supplied by the power amplifier means, and means responsive to the current-representing signal for setting the magnitude of the frequency-control signal.

7. A system according to claim 6, wherein the peak-detecting includes analog-to-digital conversion means for producing the current-representing signal as a digitally-coded signal.

8. A system according to claim 6, wherein the means for producing the frequency-control signal includes means for stepping the magnitude of the frequency-control signal so as to define a staircase waveform during each sample interval.

9. A system according to claim 7, wherein the peak-detecting means comprises digital processing means for controlling the stepping of the magnitude of the frequency-control signal.

10. Apparatus for supplying electrical power to an ultrasound-power generating crystal that has a pair of excitation electrodes and that is subjected to varying acoustic loads, which comprises:

switching circuit means for generating electrical power for the crystal and having first and second inputs and an output, and including active devices that switch on and off at a rate determined by the frequency of an oscillating signal applied to the first input, circuit means cooperating with the active devices to energize the crystal with the electrical power via a connection between the output and the excitation electrodes for controlling the level of electrical power supplied to the crystal in response to the magnitude of a variable supply voltage applied to the second input, and means for producing a current-representing signal representative of the magnitude of current supplied to energize the crystal;

sampled-data means for controlling the frequency of the oscillating signal, the sampled-data means including timing means for defining alternating sample and hold timing intervals, means for producing a frequency-control signal having a magnitude that varies during each sample interval and that remains essentially constant during each hold interval, means for supplying the oscillating signal to the first input of the switching circuit means, which includes variable-frequency oscillator means that oscillates at a frequency determined by the frequency-control signal, wherein the means for producing the frequency-control signal includes peak-detecting means operative during each sample interval for recording the magnitude of the frequency-control signal that corresponds to a peak in the current-representing signal so that throughout the ensuing hold interval the recorded peak value determines the frequency of the oscillating signal.

11. Apparatus according to claim 10 further comprising a shielded cable adapted for carrying current to the excitation electrodes.

12. Apparatus according to claim 11, wherein the shielded cable is a coax cable.

13. Apparatus according to claim 11, further including transformer means for providing a matching impedance to the crystal and comprising an input connected to the cable extending to the output of the switching circuit means, and an output adapted to be connected to the excitation electrodes.

14. Apparatus according to claim 10, wherein the peak-detecting means includes analog-to-digital conversion means for converting the current-representing signal from analog to digital form.

15. Apparatus according to claim 10, wherein the means for producing the frequency-control signal includes means for stepping the magnitude of the frequency-control signal so as to define a staircase waveform during each sample interval.

16. Apparatus for supplying ultrasound power to a patient being treated comprising an ultrasound-power generating crystal comprising a pair of excitation electrodes and that is subjected to varying acoustic loads;

switching circuit means for generating electrical power for the crystal and having first and second inputs and first and second outputs, and including active devices that switch on and off at a rate determined by the frequency of an oscillating signal applied to the first input, circuit means cooperating with the active devices to energize the crystal with the electrical power via a connection between the first output and the excitation electrodes for controlling the level of electrical power supplied to the crystal in response to the magnitude of a variable supply voltage applied to the second input, and means for producing a current-representing signal representative of the magnitude of current supplied to energize the crystal; and sampled-data means for controlling the frequency of the oscillating signal, the sampled-data means including timing means for defining alternating sample and hold timing intervals, means for producing a frequency-control signal having a magnitude that varies during each sample interval and that remains essentially constant during each hold interval, means for supplying the oscillating signal to the first input of the switching circuit means, which includes variable-frequency oscillator means that oscillates at a frequency determined by the frequency-control signal, wherein the means for producing the frequency-control signal includes peak-detecting means operative during each sample interval for recording the magnitude of the frequency-control signal that corresponds to a peak in the current-representing signal so that throughout the ensuing hold interval the recorded peak value determines the frequency of the oscillating signal.

17. Apparatus according to claim 16 wherein the crystal is generally disk-shaped, and each excitation electrode substantially covers a respective face of the crystal.

18. Apparatus according to claim 16 further comprising a shielded cable adapted for carrying current to the excitation electrodes.

* * * * *

UNITED STATES PATENT AND TRADEMARK OFFICE

CERTIFICATE OF CORRECTION

PATENT NO. : 4,966,131

DATED : October 30, 1990

INVENTOR(S) : Richard B. Houghton; Dean C. Obray

It is certified that error appears in the above-identified patent and that said Letters Patent is hereby corrected as shown below:

Column 1, line 28, after "the" and before "of" insert -- range --.
Column 1, line 29, change "Mhz" to -- MHz-- (both occurrences).

Column 2, line 24, change "Mhz" to -- MHz --.
Column 2, line 31, after "input" and before "impedance" delete ". of ."

Column 5, line 45, after "in" and before "an" delete "a".
Column 5, line 64, change "IT" to -- 1T --.

Column 6, line 28, change "singlechip" to -- single-chip --.

Column 7, line 17, change "5V" to -- +5V --.
Column 7, lines 59,60,64, change "Mhz" to -- MHz -- (all occurrences).
Column 7, line 67, after "by" change "an" to -- a --.

Column 8, line 62, after "used" and before "the" insert -- as --.

Column 9, lines 40,42,52,60, change "Mhz" to -- MHz -- (all occurrences).

Column 10, line 5, after "in the" delete "in the" (second occurrence)
Column 10, lines 5,6, change "concurrentlyfiled" to -- concurrently-filed --.

UNITED STATES PATENT AND TRADEMARK OFFICE

CERTIFICATE OF CORRECTION

PATENT NO. : 4,966,131

DATED : October 30, 1990

INVENTOR(S) : Richard B. Houghton; Dean C. Obray

It is certified that error appears in the above-identified patent and that said Letters Patent is hereby corrected as shown below:

Column 15, line 45, in the chart after "Shift6" delete "ROR SUM ;Divide by eight with rotates to the right" (second occurrence).

Column 15, line 50, after "ROR SUM+1" and before "LDA SUM+1" insert the following:

```
-- CLC              ;Clear the carry as it will be
                     part of the shift to divide
   ROR    SUM        ;Divide by eight with rotates
                     to the right
   ROR    SUM+1                                    --.
```

Column 15, line 66, after "steep" change "up slope" to -- upslope --.

UNITED STATES PATENT AND TRADEMARK OFFICE

CERTIFICATE OF CORRECTION

PATENT NO. : 4,966,131

DATED : October 30, 1990

INVENTOR(S) : Richard B. Houghton; Dean C. Obray

It is certified that error appears in the above-identified patent and that said Letters Patent is hereby corrected as shown below:

Column 17, line 1, delete "return" and before "block" insert -- returns to --.

Column 18, line 43, change "SCANNB10" to -- SCANB10 --.

In the Claims

Column 18, line 64, after "adapted" change "to" to -- for --.

Signed and Sealed this

Fourteenth Day of July, 1992

*Attest:*

*Attesting Officer*

DOUGLAS B. COMER

*Acting Commissioner of Patents and Trademarks*